US009845808B2

(12) United States Patent
McManus et al.

(10) Patent No.: US 9,845,808 B2
(45) Date of Patent: Dec. 19, 2017

(54) SPHERICAL SLEEVE AND BUSHING BEARING FOR CENTRIFUGAL PUMP STAGE

(71) Applicant: Baker Hughes Incorporated, Houston, TX (US)

(72) Inventors: David F. McManus, Broken Arrow, OK (US); Jason Ives, Broken Arrow, OK (US); Eduardo R. Rodriguez, Broken Arrow, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 416 days.

(21) Appl. No.: 14/565,543

(22) Filed: Dec. 10, 2014

(65) Prior Publication Data

US 2015/0159666 A1 Jun. 11, 2015

Related U.S. Application Data

(60) Provisional application No. 61/914,023, filed on Dec. 10, 2013.

(51) Int. Cl.

| | |
|---|---|
| ***F04D 29/046*** | (2006.01) |
| ***F04D 1/06*** | (2006.01) |
| ***F04D 13/08*** | (2006.01) |
| ***F04D 13/10*** | (2006.01) |

(52) U.S. Cl.
CPC ..... *F04D 29/0467* (2013.01); *F04D 13/10* (2013.01); *F04D 1/06* (2013.01)

(58) Field of Classification Search
CPC . F04D 1/06; F04D 13/08; F04D 13/10; F04D 29/046; F04D 29/0467; F04D 29/041; F04D 29/0413; F05B 2240/52; F05B 2240/50; F05B 2240/53
USPC ..... 415/104, 107, 229
See application file for complete search history.

(56) References Cited

U.S. PATENT DOCUMENTS

| | | | | |
|---|---|---|---|---|
| 2,047,885 A * | 7/1936 | Riebe | ..... | F16C 23/045 29/898.1 |
| 3,116,539 A * | 1/1964 | Evans | ..... | F16C 23/045 29/898.044 |
| 3,589,779 A * | 6/1971 | Sokol | ..... | F16C 23/045 384/208 |

(Continued)

FOREIGN PATENT DOCUMENTS

WO WO 2015022311 A1 * 2/2015 ..... F03D 1/0658

*Primary Examiner* — Woody Lee, Jr.
*Assistant Examiner* — Jesse Prager
(74) *Attorney, Agent, or Firm* — Bracewell LLP; James E. Bradley

(57) ABSTRACT

A centrifugal pump has a number of stages, each of the stages having an impeller and a diffuser. The impellers are mounted to the pump drive shaft for rotation. A bearing in at least one of the stages includes a sleeve coupled to the drive shaft for rotation. The sleeve has upper and lower ends and an outer side wall facing radially outward that is convex and spherical. A bushing is mounted in the diffuser and has a bore with an inner side wall facing radially inward that is concave and spherical. A pair of slots is formed in the inner side wall of the bushing 180 degrees apart from each other and extending axially. The slots enable the sleeve to be inserted into the bore with the sleeve axis and bore axis perpendicular to each other, then tilted 90 degrees to coincide the sleeve axis with the bore axis.

15 Claims, 3 Drawing Sheets

(56) References Cited

U.S. PATENT DOCUMENTS

| | | | | |
|---|---|---|---|---|
| 5,265,965 | A * | 11/1993 | Harris | F16C 23/045 384/192 |
| 5,722,812 | A | 3/1998 | Knox et al. | |
| 5,762,424 | A * | 6/1998 | Harris | F16C 23/045 384/206 |
| RE43,383 | E | 5/2012 | Semple et al. | |
| 2012/0107114 | A1* | 5/2012 | Brunner | F04D 29/041 415/229 |
| 2013/0319764 | A1* | 12/2013 | Schaaf | E21B 7/06 175/24 |

* cited by examiner

SPHERICAL SLEEVE AND BUSHING BEARING FOR CENTRIFUGAL PUMP STAGE

CROSS-REFERENCE TO RELATED APPLICATION

This application claims priority to Ser. No. 61/914,023, filed Dec. 10, 2013.

FIELD OF THE DISCLOSURE

This disclosure relates in general to centrifugal well pumps and in particular to an pump stage bearing having a rotating sleeve that fits within a stationary bushing, with a spherical interface between the sleeve and bushing.

BACKGROUND

Centrifugal well pumps are commonly used for pumping oil and water from oil wells. The pumps have a large number of stages, each stage having a stationary diffuser and a rotating impeller. The rotating impellers exert a downward thrust as the fluid moves upward. Also, particularly at startup and when the fluid flow is non uniform, the impellers may exert upward thrust. In a common pump design, the impellers float freely on the shaft so that each impeller transfers downward thrust to one of the diffusers. A thrust washer, sleeve, or bearing is located between a portion of each impeller and the upstream diffuser to accommodate the downward thrust. Another thrust washer transfers upward thrust.

Some wells produce abrasive materials, such as sand, along with the oil and water. The abrasive material causes wear of the pump components, particularly in the areas where downward thrust and upward thrust are transferred. Tungsten carbide thrust bearings and hearing sleeves along with shaping of components may be employed in these pumps to reduce wear. A number of designs for these components exist, but improvements are desirable.

SUMMARY

The centrifugal pump of this disclosure has a drive shaft and a plurality of stages, each of the stages having an impeller and a diffuser. The impellers are mounted to the drive shaft for rotation therewith. The diffusers are mounted in a housing of the pump for non rotation. A motor is operatively coupled to the pump for rotating the drive shaft.

A bearing in at least one of the stages includes a sleeve having a cylindrical opening coupled to the drive shaft for rotation therewith. The sleeve has upper and lower ends and an outer side wall facing radially outward. The outer side wall curves outward when viewed in a sleeve axis plane, defining upper and lower outer diameters at the upper and lower ends of the sleeve that are smaller than an intermediate outer diameter halfway between the upper and lower ends.

A bushing is mounted in the diffuser of at least one of the stages for non rotation. The bushing has a bore with an inner side wall curving inward when viewed in a bore axis sectional plane. The curved inner side wall defines upper and lower inner diameters at upper and lower ends of the hushing that are smaller than an intermediate inner diameter halfway between the upper and lower ends of the bushing. The sleeve locates in the bore with the outer side wall in rotational sliding contact with the inner side wall of the bore about the bore axis.

An upper hub member of the impeller of one of the stages located above the sleeve is in engagement with the upper end of the sleeve. The upper huh member applies a downward directed force to the sleeve and from the sleeve to the bushing during down-thrust of the pump.

A lower hub member of the impeller of one of the stages located below the sleeve is in engagement with the lower end of the sleeve. The lower hub member applies an upward directed force to the sleeve and from the sleeve to the bushing during up-thrust of the pump.

A pair of slots is formed in the bore of the bushing 180 degrees apart from each other and extending into the bore of the hushing from one of the ends of the bushing. Each of the slots has a circumferential width at leak equal to a height of the sleeve from the lower end to the upper end of the sleeve. The slots are radially spaced apart from each other a distance greater than the maximum outer diameter of the sleeve. The slots enable the sleeve to be inserted into the bore of the bushing while the sleeve axis is perpendicular to the bore axis, then tilted so that the sleeve axis coincides with the bore axis.

Preferably, the sleeve and the bushing are formed of materials harder than the impeller and diffuser. In the embodiment shown, the slots extend axially from one of the ends of the bushing to a termination point at the intermediate inner diameter of the inner side wall of the bushing.

An upper portion of the outer side wall of the sleeve is in rotational sliding engagement with an upper portion of the inner side wall of the bushing. A lower portion of the outer side wall of the sleeve is in rotational sliding engagement with a lower portion of the inner side wall of the bushing. An intermediate portion of the outer side wall of the sleeve is in rotational sliding engagement with an intermediate portion of the inner side wall of the hushing In the embodiment shown, the upper and lower outer diameters of the sleeve equal each other. The upper and lower inner diameters of the inner side wall of the bushing equal each other.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
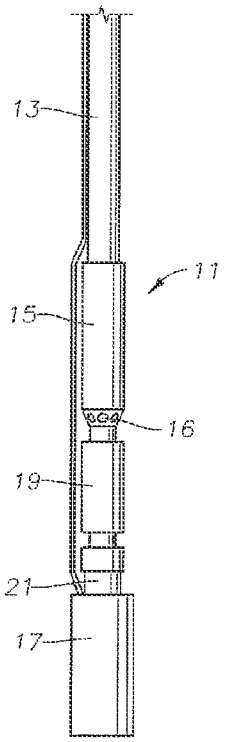
FIG. 1 is a side view of an electrical submersible pump assembly in accordance with this disclosure and installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, electrical submersible pump assembly (ESP) 11 is illustrated as being supported on production tubing 13 extending into a well. Alternately, ESP 11 could be supported by other structure, such as coiled tubing. ESP 11 includes several modules, one of which is a centrifugal pump 15 that has an intake 16 for drawing in well fluid. Another module is an electrical motor 17, which drives pump 15 and is normally a three-phase AC motor. A third module comprises a protective member or seal section 19 coupled between pump 15 and motor 17. Seal section 19 has components, such a bellows or bag, to reduce a pressure differential between dielectric lubricant contained in motor 17 and the pressure of the well fluid on the exterior of ESP 11. Intake 16 may be located in an upper portion of seal section 19 or on a lower end of pump 15. A thrust bearing 21 for motor 17 may he in a separate module or located in seal section 19 or motor 17.

ESP 11 may also include other modules, such as a gas separator for separating gas from the well fluid prior to the well fluid flowing into pump 15. The various modules may be shipped to a well site apart from each other, then assembled with bolts or other types of fasteners.

Figure 2:
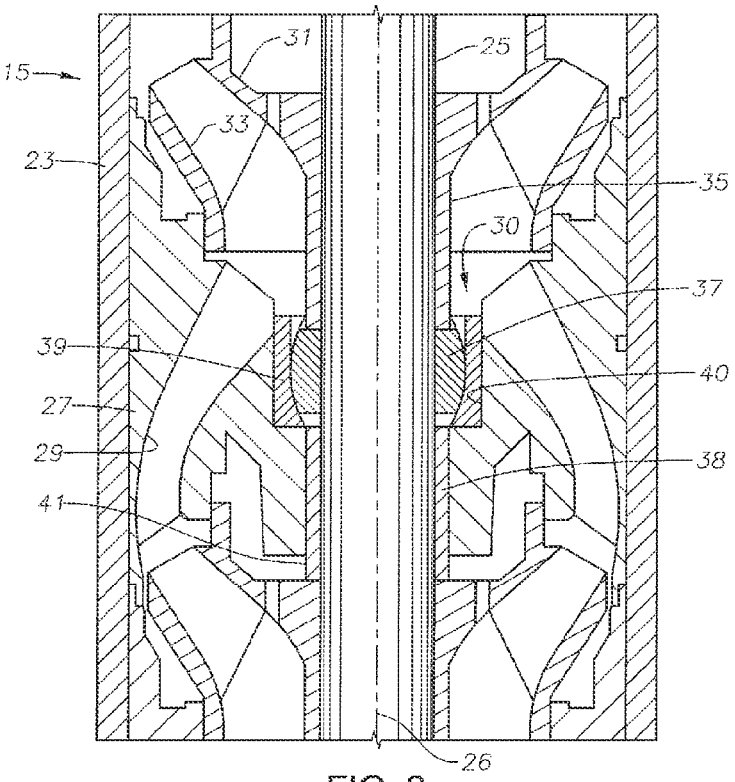
FIG. 2 is a sectional view of a portion of the pump of FIG. 1, showing one of the sleeve and bushing bearings of one of the pump stages.

Referring to FIG. 2, pump 15 includes a housing 23 that is cylindrical and much longer than its diameter. A drive shaft 25 extends along longitudinal pump axis 26 through housing 23 and is rotated by motor 17. Shaft 25 is normally made up of a different section for each module connected together with splined ends. A large number of stages are normally within housing 23, each stage including a stationary diffuser 27. Diffusers 27 are stacked on one another and secured against rotation in housing 23. Diffusers 27 have flow passages 29 leading upward and inward toward axis 26. Each stage has an impeller 31 located above the diffuser 27. Impellers 31 have flow passages 33 that lead from a central area upward and outward from axis 26. The terms "downward" and "upward" are used only for convenience, since pump 15 is not always oriented vertically as shown. The example of FIG. 2 is a mixed flow type, wherein the flow passages 29, 33 extend both axially as well as radially. Alternately, pump 15 could be a radial flow type wherein the flow passages extend primarily radially and not axially.

FIG. 2 illustrates how thrust imposed on each impeller 31 is transferred to one of the diffusers 27. Downward directed thrust is considered to be in a direction away from the direction the fluid is being pumped. Upward directed thrust can also occur, such as during startup or other conditions. Upward directed thrust is in an opposite direction to downward directed thrust. Each impeller 31 has a hub 35, which is a cylindrical member having a bore through which shaft 25 passes. In this example, a thrust runner or sleeve 37 is located below hub 35. The lower end of hub 35 abuts an upper end of sleeve 37 to transmit down-thrust from the upper impeller 31 shown to sleeve 37. Alternately, a tubular spacer (not shown) which can be considered to be a part of hub 35, may be located between the lower end of hub 35 and the upper end of sleeve 37.

A tubular spacer 38 is shown between the upper side of a next lower impeller 31 and the lower end of sleeve 37 for transmitting up-thrust from the next lower impeller to sleeve 37. Spacer 38 may also be considered to he a hub member. Sleeve 37 could be employed with only some of the pump stages or in all of the pump stages. That is, if sleeve 37 is only in some of the stages, hubs 35 could transfer thrust from one impeller 31 to another impeller 31 and eventually to sleeve 37. Sleeve 37 is a single-piece member and may he of a harder material than the material of impellers 31 and diffusers 27, such as tungsten carbide.

Figure 3:
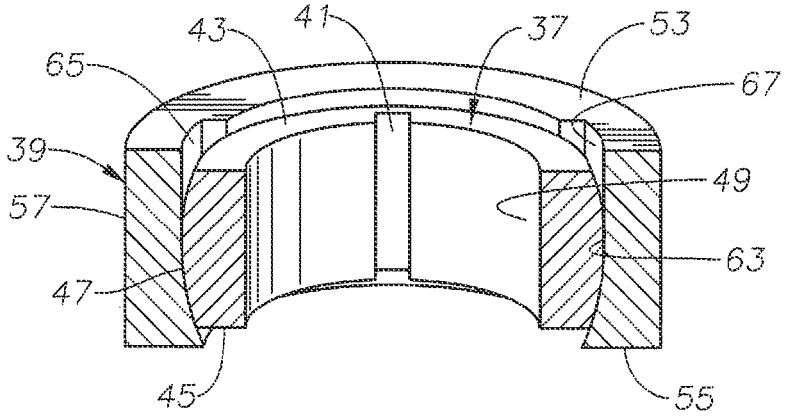
FIG. 3 is a perspective, partially sectional he sleeve and bushing bearing of FIG. 2.

Sleeve 37 seats in a thrust bushing 39, which in turn is nonrotatably supported in a diffuser receptacle 40. Bushing 39 may be press-fit in diffuser receptacle 40 or secured otherwise, such as by a retaining ring. Bushing 39 is also a single-piece member and may also he of a harder material, such as tungsten carbide, than the material of impellers 31 and diffusers 27. Sleeve 37 is secured to shaft 25 for rotation but is free to move a limited amount axially relative to shaft 25. Typically a key (not shown) engages mating axially extending grooves 41 (FIG. 3) in sleeve 37 and shaft 25.

Referring to FIGS. 3-7, sleeve 37 has an upper end 43, a lower end 45 and an external or outer side wall 47 extending from upper end 43 to lower end 45. A sleeve bore 49 that is cylindrical extends through sleeve 37 from upper end 43 to lower end 45. Sleeve bore 49 has a sleeve axis 51. External side wall 47 is convex and spherical from upper end 43 to lower end 45. The center point of the radius of curvature for side wall 47 could coincide with sleeve axis 51 or it could be smaller. External side wall 47 has a maximum outer diameter halfway between sleeve upper end 43 and sleeve lower end 45. The outer diameters at upper end 43 and lower end 45 may be the same and are smaller than the outer diameter halfway between sleeve upper end 43 and sleeve lower end 45. Key groove 41 is formed in sleeve bore 49 and extends parallel to sleeve axis 51 from upper end 43 to lower end 45.

Bushing 39 has an upper end 53, a lower end 55 and a cylindrical exterior 57. Bushing has a bore 59 with a bushing bore axis 61. Bore 59 has an inner or internal side wall 63 that is concave, spherical, and has slightly greater radius of curvature than sleeve external side wall 47. Bushing internal side wall 63 extends from bushing upper end 53 to bushing lower end 55. Internal side wall 63 has a maximum inner diameter 69 halfway between bushing upper end 53 and bushing lower end 55. The inner diameter of internal side wall 63 at upper end 53 and lower end 55 may be the same and are smaller than the maximum inner diameter 69 of internal side wall 63. The inner diameters of internal side wall 63 at any point from bushing upper end 53 to lower end 55 are slightly greater than the outer diameters of sleeve external side wall 47 at the same places so as to closely receive sleeve 37 in rotating sliding contact.

Two slots 65 spaced 180 degrees apart from each other relative to bushing axis 61 are formed in internal side wall 63. Each slot 65 extends from upper end 53 to approximately one-half the distance between bushing upper end 53 and bushing lower end 55, which is at the maximum inner diameter. Slots 65 thus do not extend all the way to bushing lower end 55 in this embodiment. Alternately, slots 65 could extend upward from bushing lower end 55 half the distance to bushing upper end 53. Each slot 65 has a base 67 with two side edges spaced circumferentially apart from each other the width of slot 65. When viewed in the cross-section of FIG. 6, base 67 of each slot 65 appears to be generally flat. However, base 67 has a circumferential curvature when viewed in a plane perpendicular to bushing axis 61 that has a radius equal to the radius of the maximum inner diameter 69 of bushing bore 59, as shown by the dotted lines in FIG. 5.

The height or axial dimension of sleeve 37 along sleeve axis 51 from upper end 43 to lower end 45 is shown to be slightly less than the height or axial dimension of bushing 39 along bushing axis 61 from upper end 53 to lower end 55. The axial dimension along sleeve axis 51 of sleeve 37 is slightly less than the circumferential width of each bushing slot 65. The maximum outer diameter of sleeve external side wall 47 is slightly less than the radial distance from base 67 of one slot 65 to base 67 of the other slot 65. The inner diameter of bushing bore 59 at upper end 53 and lower end 55 is smaller than the maximum outer diameter of sleeve external side wall 47.

Figure 8:
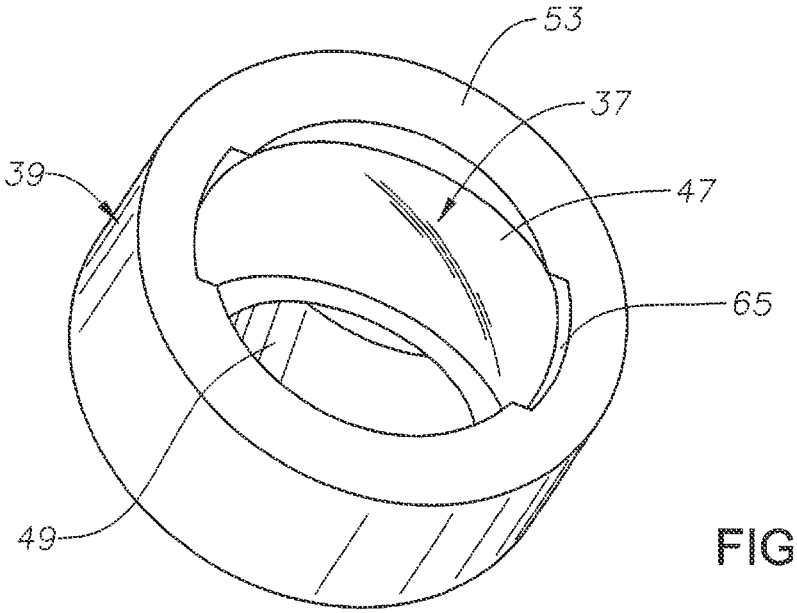
FIG. 8 is a perspective view of the sleeve and hushing of FIG. 3 with the sleeve partially inserted into the bushing.

To assemble sleeve 37 in bushing 39, an assembler will tilt sleeve 37 so that sleeve axis 51 is perpendicular to bushing axis 61. The assembler then aligns the tilted sleeve 37 with slots 65 and inserts sleeve 37 into bushing bore 59, as shown in FIG. 8. Sleeve 37 is inserted until its maximum outer diameter portion contacts the lower end of each slot 65. While still inserted, the assembler tilts sleeve 37 to a position with sleeve axis 51 coinciding with bushing axis 61. Once axes 51, 61 coincide, sleeve 37 will be trapped in bushing 39. That is, unless one reverses the installation procedure, sleeve 37 cannot be lifted relative to bushing 39 because the maximum outer diameter of sleeve external side wall 47 is greater than the inner diameter of bushing bore 59 at bushing upper end 53. Similarly, sleeve 37 will not drop downward from bushing 39 because the maximum outer diameter of sleeve external side wall 47 is greater than the inner diameter of bushing bore 59 at bushing lower end 55. Once assembled, sleeve 37 is free to rotate in bushing 39 about the common axes 51, 61.

Figure 4:
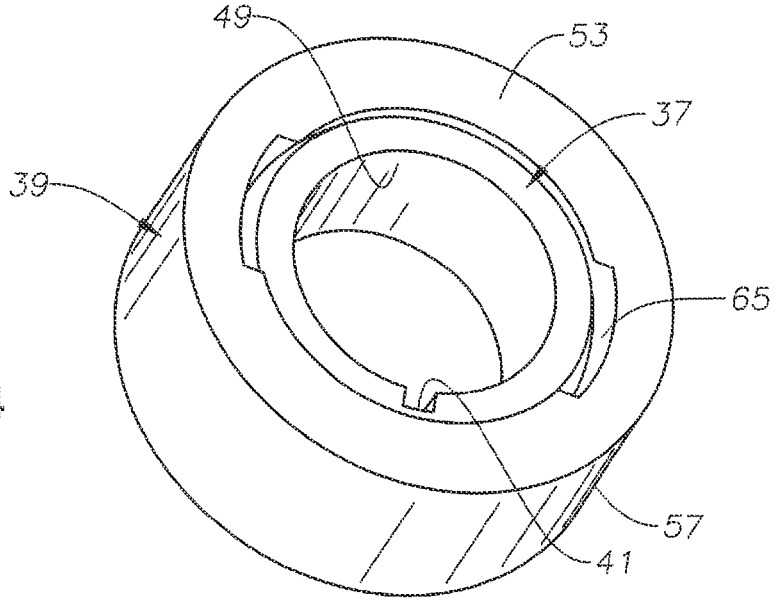
FIG. 4 is a perspective view from a different angle of the sleeve and bushing bearing of FIG. 3.
Figure 5:
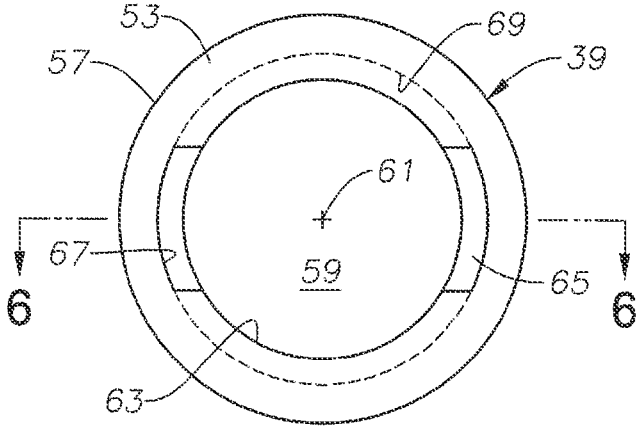
FIG. 5 is a top view of the bushing of FIG. 3 with the sleeve removed.
Figure 6:
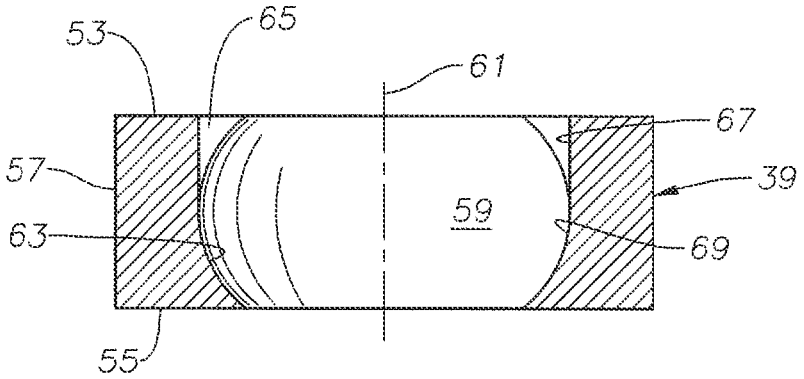
FIG. 6 is a sectional view of the bushing of FIG. 5, taken along the line 6-6 of FIG. 5.
Figure 7:
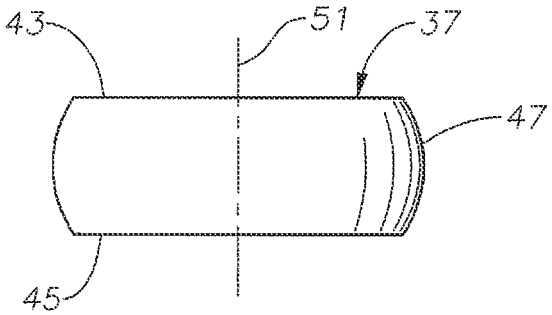
FIG. 7 is a side view of the sleeve of FIG. 3 apart from the bushing.

After assembling sleeve 37 in bushing 39 as shown in FIG. 4, the assembler slides the assembly onto pump shaft 25 (FIG. 2) into abutment with the impeller hub 35 directly above. A key (not show) will insert in sleeve groove 41 to lock sleeve 37 to shaft 25 for rotation therewith. The operator slides the adjacent diffuser 27 over shaft 25 and installs hushing 39 in receptacle 40, such as by an interference fit or a retainer ring (not shown). If by a retainer ring, some mechanism, such a key, will be used to prevent rotation of bushing 39 in receptacle 40. Bushing 39 will be axially fixed to diffuser 27 in the case of art interference fit, or optionally free to move axially a slight amount in the event a retainer ring is used.

During operation, impellers 31 and sleeves 37 rotate with shaft 25. Down-thrust from the impeller 31 above sleeve 37 transfers through impeller hub 35 to sleeve 37. The load path for the down-thrust passes through sleeve 37 and bushing 39 to diffuser 27 and housing 23. The downward force passes from the lower portion of sleeve external side wall 47 to a lower portion of bushing internal side wall 63. Similarly, during up-thrust, spacer 38 transfers the up-thrust from the next lower impeller 31 to sleeve 37. The upthrst load path transfers through sleeve 37 and bushing 39 to diffuser 27. The upward directed force passes through an upper portion of sleeve external side wall 47 into an upper portion of internal side wall 63 of bushing 39. Sleeve 37 and bushing 39 serve as a radial bearing for shaft 25, as well as a thrust bearing for upward and downward directed thrust.

While, the disclosure has been shown in only one of its forms, it should be apparent to those skilled in the art that is susceptible to changes.

The invention claimed is:

1. A submersible pump assembly, comprising:

a centrifugal pump having a drive shaft and a plurality of stages, each of the stages having an impeller and a diffuser, the impellers being mounted to the drive shaft for rotation therewith and axially slidable on the drive shaft between down-thrust and up-thrust positions, the diffusers being mounted in a housing of the pump for non rotation;

a motor operatively coupled to the pump for rotating the drive shaft;

a bearing in at least one of the stages, comprising:

a sleeve formed of a material harder than the diffuser and having a cylindrical opening coupled to the drive shaft for rotation therewith, the sleeve having upper and lower ends and an outer side wall facing radially outward relative to a sleeve axis, the outer side wall curving outward when viewed in a sleeve axis plane, defining upper and lower outer diameters at the upper and lower ends of the sleeve that are smaller than an intermediate outer diameter halfway between the upper and lower ends;

a receptacle having a cylindrical side wall in the diffuser;

a bushing formed of a material harder than the diffuser and having a cylindrical exterior, the bushing being mounted in the receptacle of the diffuser for non rotation, the bushing having a bore with a bore axis, the bore having an inner side wall curving inward when viewed in a bore axis sectional plane, defining upper and lower inner diameters at upper and lower ends of the bushing that are smaller than an intermediate inner diameter halfway between the upper and lower ends of the bushing;

the sleeve locating in the bore with the outer side wall in rotational sliding contact with the inner side wall of the bore about the bore axis;

a pair of slots formed in the bore 180 degrees apart from each other and extending into the bore from one of the ends of the bushing, each of the slots having a circumferential width at least equal to a height of the sleeve from the lower end to the upper end of the sleeve, the slots being radially spaced apart from each other a distance greater than the intermediate outer diameter of the sleeve; wherein the slots enable the sleeve to be inserted into the bore while the sleeve axis is perpendicular to the bore axis, then tilted so that the sleeve axis coincides with the bore axis;

an upper hub member of the impeller of one of the stages located above the sleeve having a lower end in engagement with the upper end of the sleeve while in the down-thrust position, the upper hub member applying a downward directed force to the sleeve and from the sleeve to the bushing and from the bushing to the diffuser during down-thrust of the pump; and a lower hub member of the impeller of one of the stages located below the sleeve that has an upper end in engagement with the lower end of the sleeve while in the up-thrust position, the lower hub member applying an upward directed force to the sleeve and from the sleeve to the bushing, and from the bushing to the diffuser during up-thrust of the pump.

2. The assembly according to claim 1, wherein the bushing is secured by an interference fit in the receptacle of the diffuser.

3. The assembly according to claim 1, wherein:

the sleeve and the bushing are formed of tungsten carbide.

4. The assembly according to claim 1, further comprising:

an upward facing shoulder in the side wall of the receptacle that is engaged by a lower end of the bushing.

5. The assembly according to claim 1, wherein:

an upper portion of the outer side wall of the sleeve is in rotational sliding engagement with an upper portion of the inner side wall of the bushing;

a lower portion of the outer side wall of the sleeve is in rotational sliding engagement with a lower portion of the inner side wall of the bushing; and an intermediate portion of the outer side wall of the sleeve is in rotational sliding engagement with an intermediate portion of the inner side wall of the bushing.

6. The assembly according to claim 1, wherein:

the upper and lower outer diameters of the sleeve equal each other; and the upper and lower inner diameters of the inner side wall of the bushing equal each other.

7. A submersible pump assembly, comprising:

a centrifugal pump having a drive shaft and a plurality of stages, each of the stages having an impeller and a diffuser, the impellers being mounted to the drive shaft for rotation therewith and axially slidable on the drive shaft between down-thrust and up-thrust position;

a motor operatively coupled to the pump for rotating the drive shaft;

a bearing in at least one of the stages, comprising:

a tungsten carbide sleeve coupled to the drive shaft for rotation therewith, the sleeve having upper and lower ends and an outer side wall facing radially outward, relative to a sleeve axis, that is convex and spherical, the upper and lower ends of the sleeve having outer diameters that are smaller than an intermediate outer diameter halfway between the upper and lower ends of the sleeve;

a cylindrical receptacle in the diffuser of said at least one of the stages;

a tungsten carbide bushing having a cylindrical exterior, the bushing being mounted with an interference fit in the receptacle of the diffuser of said at least one of the stages, the bushing having a bore with a bore axis, the bore having an inner side wall facing radially inward, relative to the bore axis, that is concave and spherical, the bore of the bushing having upper and lower inner diameters at upper and lower ends of the bushing that are smaller than an intermediate inner diameter halfway between the upper and lower ends of the bushing; the sleeve being located in the bore with the outer side wall of the sleeve in rotational sliding engagement with the inner side wall of the bushing;

a pair of slots formed in the inner side wall of the bushing 180 degrees apart from each other and extending axially relative to the bore axis, each of the slots having a circumferential width greater than a height of the sleeve between the upper and lower ends of the sleeve, enabling the sleeve to be inserted into the bore through the slots with the sleeve axis and bore axis perpendicular to each other, then tilted 90 degrees to coincide the sleeve axis with the bore axis and position the outer side wall of the sleeve in contact with the inner side wall of the bushing;

an upper hub member of the impeller of a next upper one of the stages having a lower end in engagement with the upper end of the sleeve while in the down-thrust position, the upper hub member applying a downward directed force to the sleeve and from the sleeve to the bushing and from the bushing to the diffuser during down-thrust of the pump; and a lower hub member of the impeller of a next lower one of the stages having an upper end in engagement with the lower end of the sleeve while in the up-thrust position, the lower hub member applying an upward directed force to the sleeve and from the sleeve to the bushing, and from the bushing to the diffuser during up-thrust of the pump.

8. The assembly according to claim 7, wherein each of the slots extends axially relative to the bore axis a distance that is less than a distance from an upper end to a lower end of the bushing.

9. The assembly according to claim 7, wherein each of the slots extends axially relative to the bore axis one-half a distance from an upper end to a lower end of the bushing.

10. The assembly according to claim 7, wherein each of the slots has a base wall and two circumferentially spaced-apart side edges extending radially from the base wall.

11. The assembly according to claim 7, wherein:

each of the slots has a base wall and two side edges circumferentially spaced apart from each other; and the base wall has a circumferential curvature with a radius from the bore axis that is equal to a radius of the intermediate inner diameter of the inner side wall from the bore axis.

12. The assembly according to claim 7, wherein:

the upper and lower inner diameters of the bore of the bushing equal each other and the intermediate inner diameter is greater than the upper inner diameter and the lower inner diameter;

each of the slots has an axial length, relative to the bore axis, extending from one of the ends of the bushing halfway to the other end of the bushing; and a distance from one of the slots to the other of the slots throughout the lengths of the slots is at least equal to the intermediate inner diameter.

13. A method of pumping well fluid, comprising:

providing a centrifugal pump with a drive shaft and a plurality of stages, each of the stages having an impeller and a diffuser, each of the impellers being coupled to the drive shaft for rotation therewith and being axially movable on the drive shaft between a down-thrust and an up-thrust position;

providing at least one of the stages with a sleeve of harder material than the diffuser, the sleeve having upper and lower ends and an outer side wall facing outward, relative to a sleeve axis, the outer side wall curving outward when viewed in a sleeve axis plane, defining upper and lower outer diameters at the upper and lower ends of the sleeve that are smaller than an intermediate outer diameter halfway between the upper and lower ends;

providing a bushing of harder material than the diffuser and securing the bushing in a cylindrical receptacle of the diffuser of at least one of the stages for non rotation relative to the receptacle, the bushing having a cylindrical exterior and a bore with a bore axis, the bore having an inner side wall curving inward when viewed in a bore axis sectional plane, defining upper and lower inner diameters at upper and lower ends of the bushing that are smaller than an intermediate inner diameter halfway between the upper and lower ends of the bushing;

the bushing having a pair of slots formed in the bore 180 degrees apart from each other and extending into the bore from one of the ends of the bushing, each of the slots having a circumferential width at least equal to a height of the sleeve from the lower end to the upper end of the sleeve, the slots being radially spaced apart from each other a distance greater than the intermediate outer diameter of the sleeve;

installing the sleeve in the bore of the bushing by inserting the sleeve into the bore while the sleeve axis is perpendicular to the bore axis, then tilting the sleeve so that the sleeve axis coincides with the bore axis;

coupling a motor to the pump, lowering the pump and the motor into the well and operating the motor to rotate the drive shaft, the impellers, and the sleeve, causing the outer side wall of sleeve to slidably engage the inner side wall of the bushing;

applying a downward directed force from at least one the impellers above the sleeve to the sleeve while said at least one of the impellers above the sleeve is in the down-thrust position, from the sleeve to the bushing, and from the bushing to the diffuser during down-thrust of the pump; and applying an upward directed force from at least one of the impellers below the sleeve to the sleeve while said at least one of the impellers below the sleeve is in the up-thrust position, from the sleeve to the bushing, and from the bushing to the diffuser during up-thrust of the pump.

14. The method according to claim 13, wherein:

applying the downward directed force comprises transferring the downward directed force through a lower portion of the outer side wall of the sleeve to a lower portion of the inner side wall of the bushing.

15. The method according to claim 13, wherein:

applying the upward directed force comprises transferring the upward directed force through an upper portion of the outer side wall of the sleeve to an upper portion of the inner side wall of the bushing.

* * * * *